US007542910B2

(12) United States Patent
Kellough et al.

(10) Patent No.: US 7,542,910 B2
(45) Date of Patent: Jun. 2, 2009

(54) METHOD AND APPARATUS FOR SERVING BEVERAGES AND FOR CONCEALING AND STORING WAITRESSES' CASH

(76) Inventors: Desiree Kellough, 3321 Morena Blvd., San Diego, CA (US) 92117; Lenora Kellough, 3321 Morena Blvd., San Diego, CA (US) 92117

( * ) Notice: Subject to any disclaimer, the term of this patent is extended or adjusted under 35 U.S.C. 154(b) by 299 days.

(21) Appl. No.: 11/416,412

(22) Filed: May 3, 2006

(65) Prior Publication Data

US 2007/0256956 A1 Nov. 8, 2007

(51) Int. Cl.
*G06Q 10/00* (2006.01)
*G06Q 30/00* (2006.01)

(52) U.S. Cl. ..... 705/1; 220/23.4; 220/556; 220/575; 220/756; 294/144; 294/172

(58) Field of Classification Search ..... None
See application file for complete search history.

(56) References Cited

U.S. PATENT DOCUMENTS 3,401,858 A * 9/1968 White et al. ..... 294/172
3,498,470 A * 3/1970 Thomas ..... 211/74
3,504,832 A * 4/1970 Corvetti ..... 294/144
3,941,286 A * 3/1976 Perkinson ..... 294/172
4,208,006 A * 6/1980 Bixler et al. ..... 229/406
4,320,838 A * 3/1982 Braver ..... 206/564
4,413,745 A * 11/1983 Stroud ..... 220/23.4
4,461,396 A * 7/1984 Harper ..... 220/23.83
4,744,597 A * 5/1988 Bauman et al. ..... 294/172
5,114,038 A * 5/1992 Laumann geb. Quensen .... 220/575
D326,588 S * 6/1992 Meisel ..... D7/549
D384,556 S * 10/1997 Logan et al. ..... D7/546
D386,048 S * 11/1997 Bebawey ..... D7/549
6,609,625 B1 * 8/2003 Gibbar ..... 220/574
6,732,990 B2 * 5/2004 Hudson ..... 248/311.2
7,000,799 B1 * 2/2006 Hamre ..... 220/556
D547,126 S * 7/2007 Levine et al. ..... D7/553.5
2004/0084463 A1 * 5/2004 Belasalma ..... 220/756
2007/0164579 A1 * 7/2007 Pike ..... 294/144

FOREIGN PATENT DOCUMENTS

GB 2088699 A * 6/1982

* cited by examiner

*Primary Examiner*—F. Zeender
*Assistant Examiner*—Asfand M Sheikh

(57) ABSTRACT

A food and drinks serving tray is created to include two separate areas for drinks and glassware. The separate areas are formed by an outer rim and inner rim which partially or fully prevents spillage on or off of the tray. The food and drinks serving tray includes a billfold drawer and a coin reservoir to collect and conceal a waitress' cash payment for the orders she takes. A handle can be added to the underside of the tray for easy tray handling. The food and drinks serving tray can be manufactured of different materials and have different shades of color. In addition, the food and drinks serving tray has a flat base surface which can be manufactured to come in different shapes such as a circle or rectangle.

9 Claims, 2 Drawing Sheets

METHOD AND APPARATUS FOR SERVING BEVERAGES AND FOR CONCEALING AND STORING WAITRESSES' CASH

FIELD OF THE INVENTION

The present invention pertains generally to equipment that can be used to transport food and drinks. More particularly, the present invention pertains to trays which are held by hand that are useful for carrying drinks, food, and money. The present invention is particularly, but not exclusively, useful as a method for the transferring, in an orderly fashion, of food and drinks to a restaurant patron and the separate and discreet storing of the cash received for the order of food and drinks. The present invention is particularly, but not exclusively, useful as a tray which is capable of separating drinks and food from cash. The present invention is particularly, but not exclusively, useful as a tray which separates coins from bills. The apparatus of the present invention is particularly, but not exclusively, useful to partially or fully prevent the overturn of food and liquids on the tray and subsequent spillage.

BACKGROUND OF THE INVENTION

The business of waitressing often involves the two-fold task of taking a food and drink order and serving the customer's order. During the handling of a large order or of multiple orders, the waitress may implement a serving tray. Serving trays have been used in restaurants and bars with a high degree of success. Serving trays known in the art can be of various shapes and materials.

The use of a serving tray can significantly improve the customer service of a restaurant. Specifically, the object is to save time between taking and serving an order. A waitress may place several orders on the tray to eliminate making multiple trips to the kitchen or bar to retrieve ready made orders. As a result, there is better customer response as there may be leftover time for placing an additional food or drink order and the waitress may tend to the needs of the patron is she is not far from the table and infrequently loses contact with the patron.

Another extremely important consideration of a waitress is to provide appropriate glassware to a table according to the number of guests and placed food order. Depending on the customer's wishes, an empty glass may need to be removed from a table or bar. In both cases, it is almost needless to say that it is desirable to separate the clean glassware from the used glassware that must be returned to the kitchen.

The present invention recognizes that the separation of clean glassware from used glassware mentioned above can be addressed only if the tray has divided areas for each of these types of glassware. Different types of drinks may need to be separated into different areas as well for the waitress to easily separate the orders.

Another important consideration for the design of a tray concerns the storage of a waitress' tips or order cash payment. It is known that some restaurants, as a custom, instruct that their waitresses collect payment when at the bar or table. Typically, a waitress may place the cash in the pocket, but this practice should be avoided or eliminated for at least two reasons. First, there is a risk for pickpockets to gather the waitress' money. Second, it may not be aesthetically pleasing to the management and patrons or physically comfortable for some waitresses to have heavy bulges of cash gouging into their person and causing physical stress. Thus, it is desirable if the cash received is placed away from their person in a hidden and secure spot. Furthermore, a waitress often has both hands resting on the tray and would not be able to control cash which is located by her waist in the event of a pickpocket attack. Also, with both eyes on the tray, a waitress may lose sight of the cash by her waist. Hence, the security of cash cannot be fully insured when it is placed on the person of the waitress, unless she is not carrying a tray and giving her full attention to the serving of customers.

Several currently reliable trays have attempted to handle the cash collection issue. For example, U.S. Pat. No. 2,959,274 to Moss and Messori discloses a tray with compartments to hold change and which accommodates a quantity of coins of different denominations. Further, U.S. Pat. No. 2,948,391 to McLeod also discloses a tray with a cash receptacle which has slots of various denominations.

Unlike the trays cited above, the present invention recognizes that a compartment with no slots can be used to an advantage. A waitress or server can have many other tools and personal accessories which may be placed in a hidden compartment, such as antibacterial towelettes which may be appreciated when a drink spills or is overturned. Alternatively, the waitress may use the compartment as a lost and found for patrons who may misplace an earring, ring, or cash near the table or bar. Additionally, the present invention recognizes that a rotatable bill holder and cover accommodates an easier viewing of the bills and could lead to more accuracy in the counting of the cash. Also, it is easier for the waitress to be able to take out cash from a bill holder from a variety of selective angles depending on what is anatomically easiest for the waitress.

Accordingly, and in light of the above, it is an object of the present invention to provide a tray which has separate and divided areas for carrying different types of glassware or bottles. Also, an object of the present invention is to partially or fully prevent the spillage of drinks and food off of the tray. It is another object of the present invention to provide a tray which has a cash tray that is selectively rotatable for easy cash viewing and cash handling. Still another object of the present invention is to provide a concealed cash compartment. An additional object of the present invention is to provide a separate compartment for coins which is separate from a provided compartment for bills. Yet another object of the present invention is to provide a tray which is relatively easily manufactured and is cost effective.

SUMMARY OF THE INVENTION

In one aspect the present disclosure describes a tray for carrying food and drinks in two separate areas and securing cash on the tray. The tray includes an outer rim. The outer rim may be formed to surround the perimeter of the tray. The outer rim may be constructed to have a height of between 0.5 inches and 6 inches. The rim preferably prevents the overturning of bottles or food off of the tray. In one embodiment, the outer rim is constructed to have a thickness which is easy for the waitress to grasp with her hands yet effective as a barrier for holding the glassware on the tray. The thickness of the outer rim may be between 0.03 and 0.75 inches. In accordance with the present invention, the inner rim is of the same height as the outer rim and provides a barrier to create two distinct areas for food and drinks.

Preferably, the system will include a coin chamber for the waitress to place coins she receives from a patron or from the cash register at a bar or restaurant to make change for the patron. In the most preferred embodiment, the coin chamber is concealed but easily accessible.

A key aspect of the present invention is that a tiltable billfold drawer is included for the waitress' cash or accessories such as a calculator. The billfold drawer is configured to be tilted at a tilt angle (α) from the surface of the tray. Preferably, the billfold drawer may be attached with a hole or cutaway and peg assembly. Alternatively, an assembly including screws and a hinge may be included on the inner rim and billfold drawer for attaching the billfold drawer to the tray. The billfold drawer may include a lock and key or a keypad for additional cash security.

The novel features of this invention, as well as the invention itself, both as to its structure and its operation, will best be understood from the accompanying description, in which similar reference characters refer to similar parts, and in which:

DESCRIPTION OF THE PREFERRED EMBODIMENTS

Figure 1:
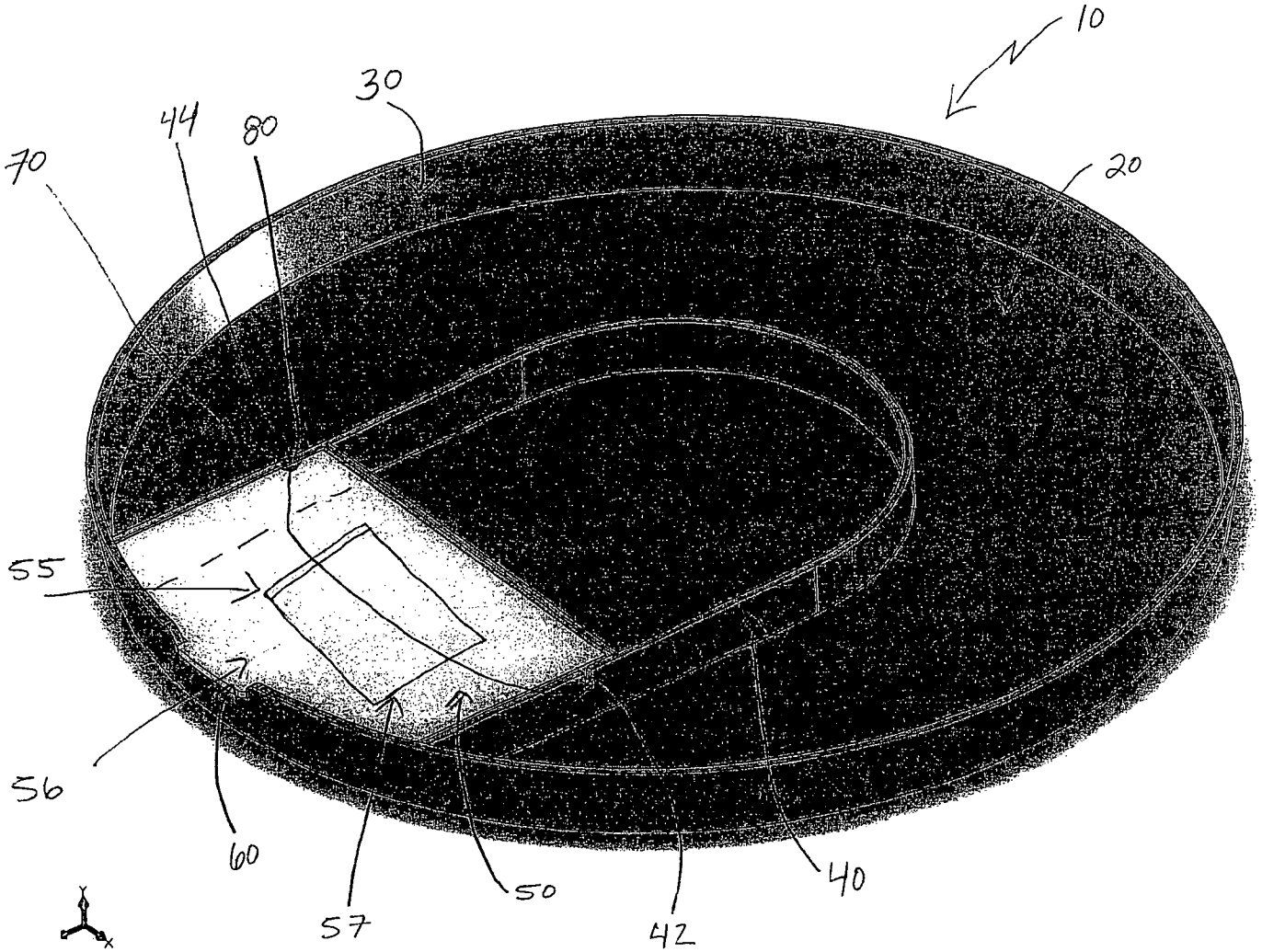
FIG. 1 is a perspective view of the food and drinks serving tray showing the bill drawer closed.

Referring initially to FIG. 1, a tray that has been manufactured in accordance with the present invention is shown and is generally designated as 10. More particularly, the construction of the tray 10 will be best appreciated with reference to FIG. 2. The tray essentially includes a base plate 20. The base plate 20 may be shaped as desired (the round shape shown in FIG. 1 is only exemplary.) The base plate 20 may also be constructed of different materials and be shaded in various colors in some embodiments. Preferably the base plate 20 has a flat surface. Surrounding the base plate 20 at its outermost diameter is an outer rim 30. This outer rim 30 provides for easy and more stable handling of the tray. Although not shown, a handle on the underside of base plate 20 also may be provided for stable handling.

An inner rim 40 is included in the tray to create a second and separate area on the tray for the purpose of either separating orders or types of food and drinks. The provision of inner rim 40 also creates an extra space for empty and additional tableware. There are two cut-outs on rim 40, cut-away 42 and cut-away 44 which are part of the attachment assembly for the bill drawer 50. As envisioned for the present invention, a billfold drawer 50 is provided. The billfold drawer 50 is preferably intended to hold cash or business cards. The inside of the billfold drawer 50 is accessed by the waitress by lifting a protrusion 60 on the billfold drawer 50. A peg 70 and a peg 80 (which is located directly across from peg 70) are attached to the billfold drawer 50 and inserted into cut-away 42 and cut-away 44 in order to removably fasten the billfold drawer 50.

As also seen in FIG. 1, the billfold drawer 50 contains a clasp 55 on the top side 56 which may be included to hold napkins or a credit card. The billfold drawer may preferably also include a pocket 57 designed to hold a calculator.

Figure 2:
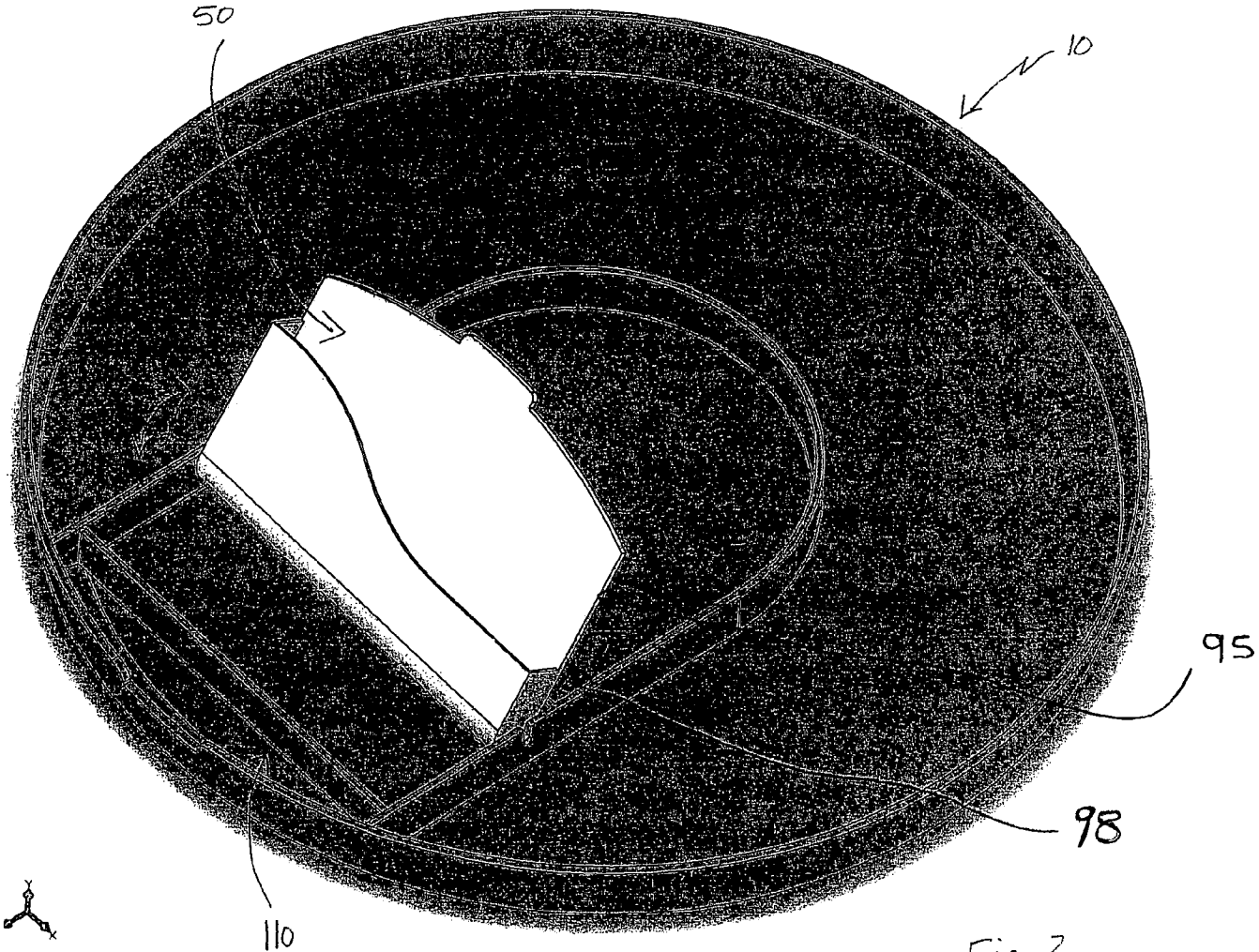
FIG. 2 is a perspective view of the food and drinks serving tray showing the bill drawer partially opened.

FIG. 2 shows the bill drawer 50 in an open position, at a tilt angle (α). The maximum angle of the tilt angle (α) is approximately 90 degrees. The back wall 95 of the bill drawer 50 operates to limit the maximum tilt angle (α) to ninety degrees. In addition, the back wall 95 of the bill drawer 50 operates as an additional barrier for the inner chamber 98 on the tray. Preferably, the barrier provides a surface for bottles or glasses to rest against in order to prevent them from overturning or spilling on or off of the tray. The coin drawer 110 is visible when the bill drawer 50 is in an open position. Preferably the bill drawer 50 is closed when the waitress is serving or taking a food or drink order.

What is claimed is:

1. A food and drinks serving tray for facilitating the separation of tableware, drinks, and food and for anatomical accommodation during the use of a billfold drawer/compartment, said tray comprising:

a circular base plate forming a tray surface, said tray surface having a diameter "d" and a thickness "t";

an outer tray rim wall, said outer tray rim wall being raised above the surface forming a first area;

an inner tray rim wall, said inner tray rim wall shaped as a horseshoe and being raised above the surface forming a second area within said first area:

a first interior wall and second interior wall disposed between the arms of said horseshoe shaped inner wall that forms a third, fourth and fifth area;

said third area enclosed by both said inner tray rim wall and said outer tray rim wall and said first interior wall creating a coin chamber for storing and securing coins;

said fourth area enclosed by said first interior wall and said second interior wall and said inner tray rim walls creating a billfold drawer/compartment area;

said billfold drawer/compartment area containing a lid that flips open that covers said third and fourth area;

said billfold drawer/compartment lid removably attached to the said arms of said horseshoe shaped inner wall;

an adjustable means for positioning said lid at a preselected angle of tilt relative to a plane of the surface of said base plate; and said fifth area providing stabilization for food or drinks.

2. A food and drinks serving tray as recited in claim 1, wherein said diameter "d" of said base plate is 12 inches.

3. A food and drinks serving tray as recited in claim 1, wherein said base plate has a thickness "t" between 0.3000 inches and 0.75 inches.

4. A food and drinks serving tray as recited in claim 1, wherein the opposite under side of said base plate has a strap or handle for easy holding of the tray.

5. A food and drinks serving tray as recited in claim 1, wherein the exterior top side surface of said billfold drawer/compartment lid includes a pocket designed for holding a calculator.

6. A food and drinks serving tray as recited in claim 1, wherein the exterior top side of said billfold drawer/compartment lid includes a clasp for holding napkins or credit cards.

7. A food and drinks serving tray as recited in claim 1, wherein said billfold drawer/compartment lid is removably attached by a spring type mechanism.

8. A food and drinks serving tray as recited in claim 1 wherein said billfold drawer/compartment lid is removably attached by screws and hinge type assembly.

9. A food and drinks serving tray as recited in claim 1, further comprising a calculator for determining, the bill of a customer or change owed to a patron.

* * * * *